US011565873B2

(12) United States Patent
Erickson et al.

(10) Patent No.: US 11,565,873 B2
(45) Date of Patent: Jan. 31, 2023

(54) AEROSOL SPOUT DISPENSER

(71) Applicant: AptarGroup, Inc, Cary, IL (US)

(72) Inventors: Gregory A Erickson, Wheaton, IL (US); Gerald J Marquardt, Elgin, IL (US); Sean Cho, Elgin, IL (US)

(73) Assignee: AptarGroup, Inc., Cary, IL (US)

( * ) Notice: Subject to any disclaimer, the term of this patent is extended or adjusted under 35 U.S.C. 154(b) by 0 days.

(21) Appl. No.: 14/503,874

(22) Filed: Oct. 1, 2014

(65) Prior Publication Data

US 2015/0090736 A1 Apr. 2, 2015

Related U.S. Application Data

(60) Provisional application No. 61/885,960, filed on Oct. 2, 2013.

(51) Int. Cl.
*B65D 83/20* (2006.01)
*B65D 83/22* (2006.01)

(52) U.S. Cl.
CPC ..... *B65D 83/205* (2013.01); *B65D 83/206* (2013.01); *B65D 83/22* (2013.01)

(58) Field of Classification Search
CPC .... B65D 83/205; B65D 83/206; B65D 83/22; B65D 47/241; B65D 47/248; B65D 47/249; B65D 83/201; B65D 83/16; B65D 83/20
USPC ..... 222/153.11, 402.13, 402.15, 402.11
See application file for complete search history.

(56) References Cited

U.S. PATENT DOCUMENTS

| | | | | |
|---|---|---|---|---|
| 2,678,147 | A | 5/1954 | Abplanaip | |
| 3,138,331 | A * | 6/1964 | Kutik | B65D 83/206 239/337 |
| 3,149,757 | A | 9/1964 | Safianoff | |
| 3,156,382 | A | 11/1964 | Michell | |
| 3,185,350 | A | 5/1965 | Abplanalp | |
| 3,325,054 | A * | 6/1967 | Braun | B65D 83/205 222/39 |
| 3,426,913 | A | 2/1969 | Stirling | |
| 3,426,948 | A | 2/1969 | Stirling | |
| 3,484,023 | A | 12/1969 | Meshberg | |
| 3,580,432 | A | 5/1971 | Brooks | |

(Continued)

FOREIGN PATENT DOCUMENTS

| | | |
|---|---|---|
| EP | 409497 | 1/1891 |
| EP | 119084 | 9/1985 |

(Continued)

*Primary Examiner* — Benjamin R Shaw
(74) *Attorney, Agent, or Firm* — Frijouf, Rust & Pyle P.A.

(57) ABSTRACT

An aerosol spout dispenser is disclosed for dispensing an aerosol product from an aerosol container through an aerosol valve. The aerosol spout dispenser comprises a base secured to the aerosol container with a dispensing head mounted to the base. A dispensing spout extends outwardly from the dispensing head beyond the mounting cup of the aerosol container. A depression of the dispensing head actuates the aerosol valve to dispense the aerosol product from a terminal orifice. A dispensing head retainer cooperates with a base retainer for inhibiting separation of the dispensing head from the base when a separating force is applied between the dispensing head and the base. An auxiliary latching mechanism inhibits separation of the dispensing head from the base when a separating force is applied between the dispensing spout and the base.

12 Claims, 15 Drawing Sheets

(56) References Cited

U.S. PATENT DOCUMENTS

| | | | | |
|---|---|---|---|---|
| 3,591,128 | A | 7/1971 | Ramis | |
| 3,601,290 | A | 8/1971 | Nigro | |
| 3,707,705 | A | 12/1972 | Howell, Jr. et al. | |
| 3,721,423 | A | 3/1973 | Shay | |
| 3,744,682 | A | 7/1973 | Blank | |
| 3,768,707 | A | 10/1973 | Nigro | |
| 3,797,705 | A | 3/1974 | Cooprider | |
| 3,848,778 | A | 11/1974 | Meshberg | |
| 3,860,149 | A | 1/1975 | Hagionis | |
| 3,933,283 | A * | 1/1976 | Hoagland | B65D 83/205 222/402.13 |
| 3,967,760 | A | 7/1976 | Marcon | |
| 4,024,988 | A | 5/1977 | Starrett | |
| 4,324,351 | A | 4/1982 | Meshberg | |
| 4,354,621 | A | 10/1982 | Knickerbocker | |
| 4,418,842 | A | 12/1983 | DiLoreto | |
| 4,542,837 | A | 9/1985 | Rayneer | |
| 4,566,611 | A | 1/1986 | Sukopp | |
| 4,773,567 | A | 9/1988 | Stoody | |
| 5,388,730 | A | 2/1995 | Abbott et al. | |
| 5,549,226 | A | 8/1996 | Kopp | |
| 5,549,228 | A | 8/1996 | Brown | |
| 5,649,645 | A | 7/1997 | Demarest et al. | |
| 5,762,322 | A | 6/1998 | Smith | |
| 5,918,774 | A | 7/1999 | Lund | |
| 5,957,337 | A | 9/1999 | Bettison, Jr. | |
| 5,971,214 | A | 10/1999 | Bettison, Jr. | |
| 5,971,230 | A | 10/1999 | Tanaka | |
| 6,299,027 | B1 | 10/2001 | Berge et al. | |
| 6,302,302 | B1 | 10/2001 | Albisetti | |
| 6,523,722 | B1 | 2/2003 | Clark et al. | |
| 6,695,171 | B2 | 2/2004 | Walters et al. | |
| 6,758,373 | B2 | 7/2004 | Jackson et al. | |
| D509,136 | S * | 9/2005 | Walters | D9/447 |
| 7,004,359 | B2 | 2/2006 | Marroncles | |
| 7,044,337 | B1 | 5/2006 | Kou | |
| 7,124,916 | B2 * | 10/2006 | Groh | B65D 83/206 222/402.13 |
| D567,654 | S * | 4/2008 | Geiberger | D9/448 |
| 7,487,891 | B2 * | 2/2009 | Yerby | B65D 83/206 222/153.13 |
| 7,611,032 | B2 * | 11/2009 | Brunerie | B65D 83/22 222/153.11 |
| 7,699,190 | B2 * | 4/2010 | Hygema | B65D 83/16 222/39 |
| 8,100,298 | B2 * | 1/2012 | Marquardt | B65D 83/22 222/153.11 |
| 8,356,734 | B2 | 1/2013 | Oshimo | |
| 10,435,227 | B2 | 10/2019 | Aptar | |
| 2003/0168473 | A1 | 9/2003 | Ho | |
| 2005/0017026 | A1 | 1/2005 | Yerby et al. | |
| 2005/0017027 | A1 * | 1/2005 | Yerby | B65D 83/22 222/402.13 |
| 2008/0210710 | A1 | 9/2008 | Marquardt | |
| 2009/0050650 | A1 | 2/2009 | Walters et al. | |
| 2009/0127293 | A1 | 5/2009 | De Laforcade | |
| 2009/0283609 | A1 | 11/2009 | Strand | |
| 2010/0025437 | A1 | 2/2010 | Oshimo | |
| 2011/0233235 | A1 * | 9/2011 | Adams | B65D 83/205 222/402.13 |
| 2012/0048959 | A1 | 3/2012 | Maas | |
| 2013/0277397 | A1 * | 10/2013 | Erickson | B65D 83/205 222/153.11 |
| 2018/0200738 | A1 * | 7/2018 | Fore | B65D 83/22 |
| 2020/0245740 | A1 * | 8/2020 | Han | A45D 27/02 |

FOREIGN PATENT DOCUMENTS

| | | |
|---|---|---|
| EP | 503735 | 9/1992 |
| EP | 0 659 157 | 6/1995 |
| EP | 0935567 | 4/1998 |
| EP | 1061007 | 5/2000 |
| EP | 1 219 547 | 7/2002 |
| EP | 1323644 | 7/2003 |
| JP | 2001/097464 | 4/2001 |
| JP | 2001097464 | 4/2001 |
| JP | 2003/305390 | 10/2003 |
| JP | 2003305390 | 10/2003 |
| JP | 2004/050130 | 2/2004 |
| JP | 2664050136 | 2/2004 |
| WO | WO 98/16439 | 4/1998 |
| WO | WO 99/33716 | 7/1999 |
| WO | WO 2007-022422 | 2/2007 |

* cited by examiner

AEROSOL SPOUT DISPENSER

CROSS-REFERENCE TO RELATED APPLICATIONS

This application claims benefit of U.S. Patent Provisional application No. 61/885,960 filed Oct. 2, 2013. All subject matter set forth in provisional application No. 61/885,960 filed Oct. 2, 2013 is hereby incorporated by reference into the present application as if fully set forth herein.

BACKGROUND OF THE INVENTION

Field of the Invention

This invention relates to dispensing and more particularly to an improved aerosol spout dispenser.

Description of the Related Art

An aerosol dispenser comprises an aerosol product and an aerosol propellant contained within an aerosol container. An aerosol valve is provided to control the discharge of the aerosol product from the aerosol container through the fluid pressure provided by the aerosol propellant. The aerosol valve is biased into a closed position. A valve stem cooperates with the aerosol valve for opening the aerosol valve. An actuator engages with the valve stem to open the aerosol valve for dispensing the aerosol product from the aerosol container. The following US patents are examples of the aerosol devices of the prior art.

U.S. Pat. No. 2,995,308 to Ashkenaz discloses a jet stream dispenser which may serve as a closure for a container of volatile refrigerant used for inducing local anesthesia or analgesia in minor surgery.

U.S. Pat. No. 3,138,331 to Kutik discloses a spraying device adapted to be fitted upon the top of a pressurized or spray can to spray the contents thereof.

U.S. Pat. No. 3,189,232 to Joffe discloses a dispenser for an aerosol container of the type having a dispensing valve that is adapted to dispense upon depression thereof. The proposed device provides a dispensing attachment that may be applied readily to a container after which the operation of some manual device such as a trigger, will effect the dispensing of the contents of the container in a controlled and effective manner.

U.S. Pat. No. 3,429,484 to Baldwin discloses an attachment for an aerosol container of the type having an annular shoulder encompassing a spray head. An inverted U-shaped jaw clamp has side legs with inturned flanges at lower ends underposed with respect to the shoulder. An actuator includes a portion extending transversely of the legs through apertures therein and is pivoted at one end to one leg and a superposed with respect to the spray head. A hand operated handle extends from said portion downwardly along side the container.

U.S. Pat. No. 3,648,905 to Kauder discloses a pressure container having an outlet valve actuated by tilting the outlet nozzle with a lever arm extending from the nozzle downwardly and outwardly in proximity to the container to facilitate one-hand operation. Also provided is a releasable locking member cooperating with the lever arm construction to prevent premature or accidental operation.

U.S. Pat. No. 3,987,942 to Morane, et al. discloses a dispensing cap for pressurized containers comprising a wall adapted to snap onto the top of the container. A movable member defines a duct adapted to seat on the outlet tube of the container valve and through which its contents may be ejected. A separable actuating member projects through the wall to actuate the movable member.

U.S. Pat. No. 4,826,054 to Frutin discloses the valve of an aerosol can actuated by a lever having a handle portion and an intermediate portion bearing on a lock member. The lever is pivotably mounted in a clip. The lock member is in screw-threaded engagement with the valve for movement therealong between closed and open positions. The lock member can be placed in any intermediate position to set a desired flow rate through the valve when the lever is depressed by the user.

U.S. Pat. No. 5,040,705 to Snell discloses a flow control apparatus for controlling the flow of a material from a container valve comprising a flow control member adapted to be mounted on the valve for rotation relative to the valve for adjustably positioning the flow control member relative to the valve and container and thereby adjustably setting a maximum permissible flow rate of material which can be dispensed from the container through the valve. A trigger is mounted on the container and pressed for moving the flow control member and valve stem to dispense material from the container. A ring is rotatably mounted on an annular rim of the container. The rim mounts the trigger so that it can rotate the flow control member. Rotation of the ring rotates the trigger, and in turn, the flow control member in an easy, safe manner without risk of possible injury to the fingers from contact with a stationary trigger support. The container is preferably necked at its upper end such that the annular diameter of the mounting ring on the annular rim of the container does not protrude outwardly of the cylindrical side wall of the container for safety and compactness in use.

U.S. Pat. No. 6,340,103 to Scheindel, et al. discloses a dispensing mechanism for a pressurized container employing a platform which sits on and engages the valve cap. A lever pivoted on the platform extends from its pivot point up and around the nozzle to terminate in the handle that is adjacent to the sidewall of the pressurized container. The upper portion of the lever engages the shoulder on the nozzle so that when the handle is manually squeezed against the sidewall of the container. The lever pushes down on the nozzle thus pushing the nozzle and valve in a downward axially direction thereby dispensing the pressurized contents of the container. It is when the nozzle is screwed into a dispensing state that the handle or the lever is pivoted away from the sidewall of the can so that it can be squeezed against the can to effect the dispensing of the contents.

U.S. Pat. No. 6,494,349 to Thompson, et al. discloses a hand-held pressurized product dispenser that includes a container with a hand-engageable body portion. A valve mechanism at the top of the container is movable with respect to the container to cause pressurized discharge of the product. A valve actuation lever is connected to the valve mechanism and extends along the container body such that a larger displacement of the end of the lever causes a controlled, relatively smaller displacement of the valve mechanism permitting adjustable "throttled" delivery of the product. Also disclosed are a product delivery member that is attached to the top of container and has a product holding structure that is positioned with respect to the valve mechanism to receive product and to hold the product in position for application. Cam members are oriented to cause the valve actuating lever to move downward as it is moved toward the container body. A movable stop member is carried on the container and faces the hand-engageable portion so as to limit travel of the hand-engageable portion toward the container.

U.S. Pat. No. 6,685,064 to Frutin discloses a dispensing apparatus for dispensing a product from a container including a product chamber within the container and a valve adjacent to the product chamber. A hinge assembly is secured to the opening of the container and to which is connected a nozzle assembly. A lever is attached by means of the hinge assembly. The nozzle assembly is rotatable between open and closed positions and includes an actuator portion provided with a cam surface which co-operates with a bearing portion on the lever such that, when the nozzle assembly is in the open position, operation of the lever causes movement of the actuator portion to open the valve and permit flow of the product out of the container.

U.S. Pat. No. 6,722,532 to Lasserre, et al. discloses a dispenser unit comprising a housing and an actuator movable relative to the housing to cause the contents of two containers to be dispensed simultaneously in mixed or separate state. Each container includes a hollow stem through which the substance is dispensed when the stem is depressed. The dispenser unit includes a fluid-conducting member distinct from the actuator and including two hoods for engaging the two stems of the containers. Depressing the actuator causes the fluid-conducting member to actuate the stems and initiate dispensing of the contents into a single passage or two separate passages of the fluid-conducting member. The fluid-conducting member is movable within the housing for accommodating mismatch in heights of the stems. The actuator includes a single internal channel or two separate channels for receiving the container contents from the fluid-conducting member.

U.S. Pat. No. 6,820,777 to Frutin discloses a dispensing apparatus for dispensing a product from a container including a product chamber within the container and a valve adjacent to the product chamber. A hinge assembly is secured to the opening of the container and to which is connected a nozzle assembly and a lever attached by a hinge assembly. The nozzle assembly is rotatable between open and closed positions. An actuator portion is provided with a cam surface which co-operates with a bearing portion on the lever such that, when the nozzle assembly is in the open position, operation of the lever causes movement of the actuator portion to open the valve and permit flow of the product out of the container.

U.S. Pat. No. 7,124,916 to Groh, et al. discloses a hand-held pressurized product dispenser including a container containing a product under pressure and a valve mechanism and base structure at the top of the container. A nozzle moves between an unactuated position and a discharge position. A side lever extends along the can and is movable to move the nozzle from the unactuated position to the discharge position. The dispenser has a dome rotatably connected to the base structure and surrounds the nozzle and interacts with the nozzle to cause rotation of the nozzle between a locked position and an unlocked position. The nozzle has one or more downwardly directed feet that align with solid areas of an upwardly directed surface in the locked position and that align with open areas of the base structure in the unlocked position such that the nozzle is free to move into the discharge position.

U.S. Pat. No. 7,631,785 to Paas et al. discloses a dispensing spout for a container including a recess defined by one or more walls that protrude downwardly surrounding an actuating button of an overcap of the container. The dispensing spout is attached to the actuating button. The dispensing spout further includes an aperture disposed in the recess above an outlet in the actuating button and a lever disposed on a side of the dispensing spout. Pressing the lever towards the container forces the walls defining the recess downward displacing the actuating button.

U.S. Pat. No. 7,641,079 to Lott, et al. discloses a cover and trigger assembly that includes having a valve that can be actuated for dispensing the contents of the can through an outlet of the valve. The assembly includes an annular component having a helical surface secured to the can. A cover is coupled to the annular component. The cover has an opening through which a trigger extends. The cover is rotatable relative to the helical surface on the annular component for rotatably raising or lowering the cover relative to the annular component. The raising or lowering of the cover respectively prohibits or permits movement of the trigger member to actuate the valve, thereby controlling dispensing operation of the valve.

U.S. Pat. No. 7,891,529 to Paas et al. discloses a dispensing spout for a container including a recess defined by one or more walls that protrude downwardly surrounding an actuating button of an overcap of the container wherein the dispensing spout is attached to the actuating button. The dispensing spout further includes an aperture disposed in the recess above an outlet in the actuating button and a lever disposed on a side of the dispensing spout. Pressing the lever towards the container forces the walls defining the recess downward displacing the actuating button.

U.S. Pat. No. 7,959,040 to Heirman discloses a dispensing device for dispensing a product. The dispensing device comprises: a container containing the product under pressure. The container has a top, bottom and body portion. An axial direction is defined between the bottom and top. A valve mechanism is mounted at the top of the container. The valve mechanism is movable with respect to the container for pressurized discharge of the product out of the container. A dispensing cap is mounted on the top of the container. The dispensing cap carries a nozzle debouching outside the cap for spraying the product. The nozzle is connected to the valve mechanism by a conduit. An actuating member has a horizontal arm and a vertical arm. The horizontal arm is hingedly suspended in the cap and engages the valve mechanism to actuate the valve mechanism upon pulling the vertical arm towards the container portion. The body portion of the container has a lower portion and an upper portion providing a one-hand grip. The vertical arm engages at least one finger of a hand gripping the one-hand grip. The one-hand grip is constricted in its circumference with respect to the lower portion.

United States Patent Application No. 2003/0075571 to Thompson, et al. discloses a hand-held pressurized product dispenser that includes a container with a hand-engageable body portion. A valve mechanism at the top of the container is movable with respect to the container to cause pressurized discharge of the product. A valve actuation lever is connected to the valve mechanism and extends along the container body such that a larger displacement of the end of the lever causes a controlled, relatively smaller displacement of the valve mechanism, permitting adjustable "throttled" delivery of the product. A product delivery member is attached to the top of container and has a product holding structure that is positioned with respect to the valve mechanism to receive product and to hold the product in position for application. Cam members are oriented to cause the valve actuating lever to move downward as it is moved toward the container body. A movable stop member is carried on the container and faces the hand-engagable portion so as to limit travel of the hand-engageable portion toward the container.

United States Patent Application 2004/0256418 to Scheindel discloses an axially actuated valve assembly for use in a pressurized container that is easily actuated and controlled by a user to dispense the amount of product desired. The valve stem is moved in an up and down direction so that when dispensing, the user can control amount of the valve openings that are in communication with the material to be dispensed. The flexible boot surrounds the valve stem by having an upper edge that engages the valve actuating ledge and a lower edge that engages the button when in the non-dispensing state. The boot has a squared off lower interior edge engaging the stem and the button of the valve member when in the non-dispensing state. The button of valve is small in diameter and less than the surface of the boot that the button engages. The boot has a substantially straight thin wall neck below the upper edge. Two slits in the neck reduce hoop strength to facilitate outward bowing of the mark when the valve is depressed. The upper edge extends radially inward of the thin wall neck sufficiently to further assure outward bowing of the thin wall as the valve is depressed into the dispensing state.

U.S. Pat. No. D627,224 to Bass, et al. discloses an ornamental design for an overcap.

U.S. Pat. No. D635,854 to Bass, et al. discloses an ornamental design for an overcap.

Others have incorporated a locking feature for inhibiting the dispensing of the aerosol product from the aerosol container. The following U.S. patents disclose novel inventions incorporating a locking feature for inhibiting the dispensing of the aerosol product from the aerosol container U.S. Pat. No. 7,487,891 to Yerby et al. discloses an actuator for actuating an aerosol valve for dispensing an aerosol product from an aerosol container. The actuator comprises an actuator button being rotatable relative to a base for movement between a locked rotational position and an unlocked rotational position. The actuator button has a rigid sidewall supporting a rigid top actuating surface with an actuator button orifice defined in the sidewall of the actuator button. The actuator button is movable relative to the base for actuating the aerosol valve to dispense the aerosol product when the actuator button is rotated into the unlocked rotational position. The actuator button is inhibited from actuating the aerosol valve when the actuator button is moved into the locked rotational position.

U.S. Pat. No. 8,100,298 to Marquardt et al. discloses an actuator for actuating an aerosol valve for dispensing an aerosol product from an aerosol container. The improved actuator comprises a base for mounting to the aerosol container. A unitary actuator button supports a nozzle extending between the aerosol valve and a terminal orifice. The actuator button is rotatable about the base between a locked rotational position and an unlocked rotational position. The unitary actuator button is movable for pivoting the nozzle button to actuate the aerosol valve for dispensing aerosol product from the terminal orifice when the actuator button is in the unlocked rotational position. The unitary actuator button is inhibited from pivoting the nozzle button when the actuator button is rotated into the locked rotational position.

U.S. Pat. No. 8,127,968 to Yerby et al. discloses an actuator for actuating an aerosol valve for dispensing an aerosol product from an aerosol container. The actuator comprises an actuator button being rotatable relative to a base for movement between a locked rotational position and an unlocked rotational position. The actuator button is tiltable relative to the base for actuating the aerosol valve to dispense the aerosol product when the actuator button is rotated into the unlocked rotational position. The actuator button is inhibited from tilting relative to the base when the actuator button is moved into the locked rotational position. The rotational movement of the actuator between the locked rotational position and the unlocked rotational position is accompanied by a double click.

It is an object of the present invention to improve upon the above art to provide an aerosol spout dispenser that provides a significant advancement to the aerosol dispensing art.

Another object of this invention is to provide an aerosol spout dispenser including a dispensing spout.

Another object of this invention is to provide an aerosol spout dispenser including a dispensing spout extending outwardly from a dispensing head beyond a mounting cup of an aerosol container.

Another object of this invention is to provide an aerosol spout dispenser having a retainer for inhibiting separation of the dispensing head from the base when a separating force is applied between the dispensing head and the base.

Another object of this invention is to provide an aerosol spout dispenser having an auxiliary latching mechanism for inhibiting separation of the dispensing head from the base when a separating force is applied between the dispensing spout and the base.

Another object of this invention is to provide an aerosol spout dispenser that may be actuated either by a dispensing spout or alternately be actuated by a depression of a dispenser head.

Another object of this invention is to provide an aerosol spout dispenser having a reduced number of parts.

Another object of this invention is to provide an aerosol spout dispenser that includes a lock for inhibiting actuation of the aerosol spout dispenser.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to a two-piece aerosol spout dispenser for dispensing an aerosol product from an aerosol container having a mounting cup for supporting an aerosol valve. The aerosol spout dispenser has a first piece comprising a base having a mounting unitary with the base for securing the base to the mounting cup of the aerosol container. A base retainer is unitary with the base. A second piece comprises a dispensing head having a sidewall supporting a top surface. A dispensing spout defining a terminal orifice extends from the dispensing head and defines a nozzle channel communicating the terminal orifice with the aerosol valve. The dispensing spout extends beyond the mounting cup of the aerosol container. The dispensing head is tiltable relative to the base upon depression of the dispensing head for opening the aerosol valve to dispense the aerosol product from the terminal orifice. A dispensing head retainer cooperates with a base retainer for inhibiting separation of the dispensing head from the base when a separating force is applied between the dispensing head and the base. An auxiliary latching mechanism inhibits separation of the dispensing head from the base when a separating force is applied between the dispensing spout and the base.

In a more specific embodiment of the invention, the base has an outer ring and an inner ring defining an annular void between the outer ring and the inner ring of the base. A portion of the dispensing head extends into the annular void between the outer ring and the inner ring of the base. The dispensing head is tiltable within the annular void of the base upon depression of the dispensing spout for opening the aerosol valve to dispense the aerosol product from the terminal orifice.

In another specific embodiment of the invention, a lock interacts between the base and the dispensing head to inhibit the dispensing head from actuating the aerosol valve. In one specific example, the dispensing head is rotatably mounted to the base for rotation between a locked rotational position and an unlocked rotational position. The dispensing head actuates the aerosol valve upon depression of the dispensing head when the dispensing head is rotated into the unlocked rotational position. The dispensing head is inhibited from actuating the aerosol valve when the dispensing head is rotated into the locked rotational position.

In still another specific embodiment of the invention, the dispensing head has a first actuator surface defined by a top surface of the dispensing spout and a second actuator surface defined by a surface of the dispensing head actuator below the dispensing spout. Each of the first and second actuation surfaces is capable of actuating the aerosol valve for dispensing the aerosol product from the terminal orifice when the lock is in the unlocked position. Each of the first and second actuation surfaces is inhibited from actuating the aerosol valve when the lock is in the locked position.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
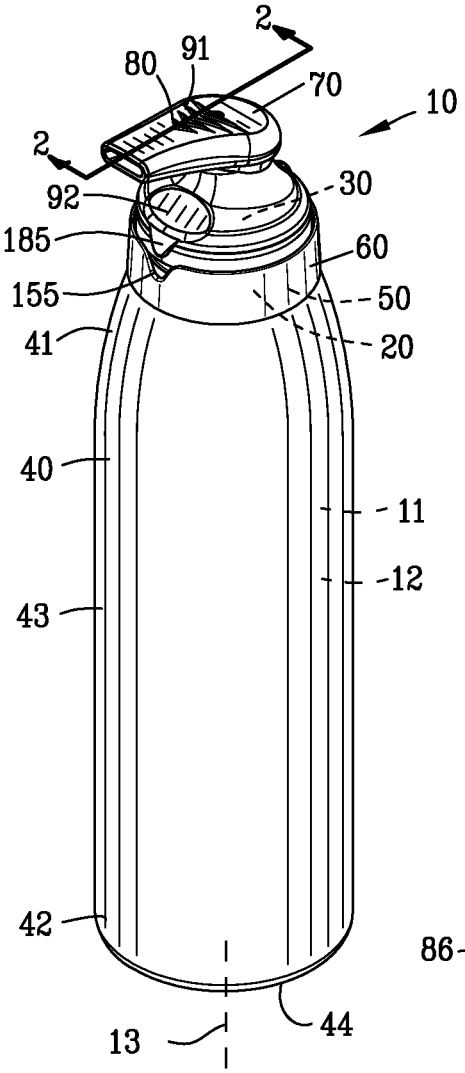
FIG. 1 is a top isometric view of an improved aerosol spout dispenser of the present invention located on an aerosol container.
Figure 2:
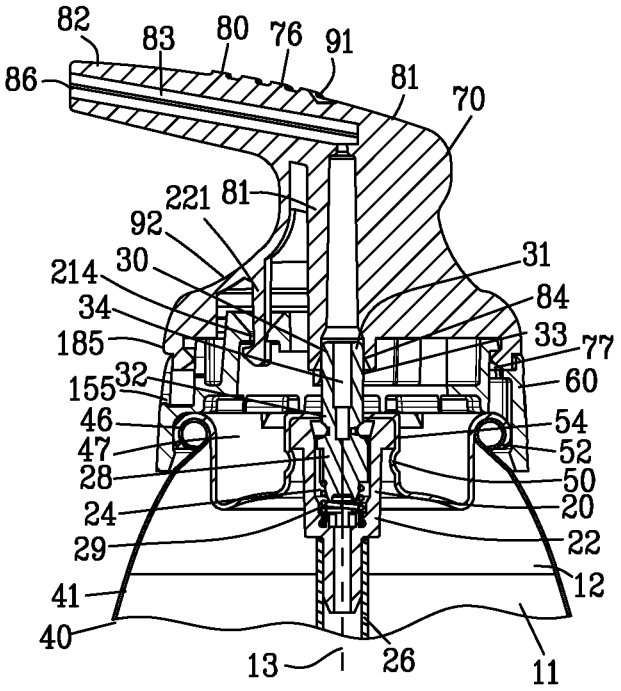
FIG. 2 is an enlarged partial sectional view along line 2-2 in FIG. 1.
Figure 3:
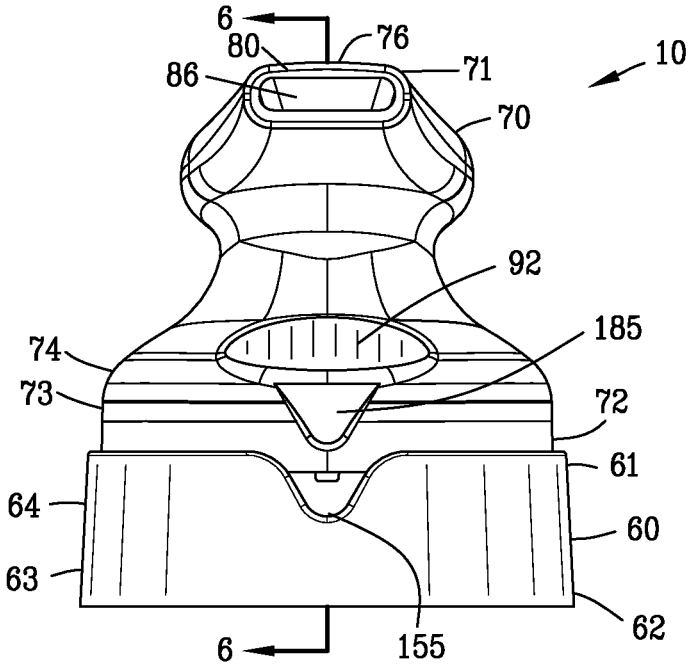
FIG. 3 is an enlarged front view of the aerosol spout dispenser of FIG. 1.
Figure 4:
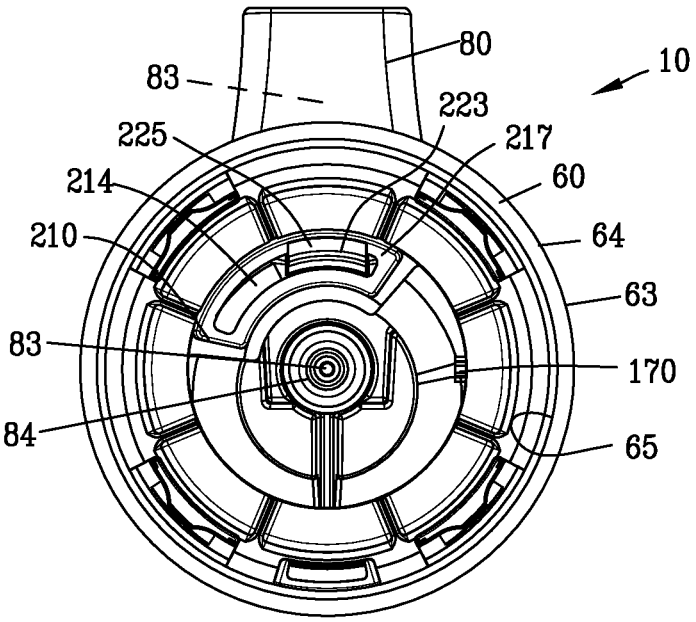
FIG. 4 is a bottom view of FIG. 3.

FIGS. 1 and 2 illustrate a first embodiment of the improved aerosol spout dispenser 10 of the present invention for dispensing an aerosol product 11 with an aerosol propellant 12. The terms aerosol product 11 and aerosol propellant 12 as used herein includes all types of pressurized package dispenser including pressurized gases or bag on valve dispensers.

The aerosol spout dispenser 10 defines an axis of symmetry 13 of the aerosol spout dispenser 10. An aerosol valve 20 having a valve stem 30 cooperates with the aerosol spout dispenser 10 to control the flow of the aerosol product 11 from an aerosol container 40.

The aerosol container 40 is shown as a cylindrical container of conventional design and material. The aerosol container 40 extends between a top portion 41 and a bottom portion 42 with a cylindrical sidewall 43 located therebetween. The bottom portion 42 of the aerosol container 40 is closed by an endwall 44. Although the aerosol container 40 has been shown as a conventional design, it should be understood that the aerosol spout dispenser 10 of the present invention may be used with aerosol containers of various designs.

As best shown in FIG. 2, the aerosol container 40 terminates in a bead 46 defining an opening 47 in the aerosol container 40 for receiving a mounting cup 50. The mounting cup 50 includes a peripheral rim 52 for sealing to the bead 46 of the aerosol container 40. The mounting cup 50 further comprises a turret 54 for receiving the aerosol valve 20.

The aerosol valve 20 includes a valve body 22 secured to the turret 54 of the mounting cup 50 by a conventional crimping process. The valve body 22 defines an internal valve cavity 24 in fluid communication with the aerosol container 40 through a dip tube 26. The aerosol valve 20 includes a valve element 28 positioned within the internal valve cavity 24. A bias spring 29 biases the valve element 28 into a closed position to inhibit the flow of the aerosol product 11 through the valve stem 30.

The valve stem 30 extends between a first end 31 and a second end 32 and defines an outer surface 33 with a stem passageway 34 extending therein. The stem passageway 34 provides fluid communication from the internal valve cavity 24 of the valve body 22 to the second end 32 of the valve stem 30. A depression of the valve stem 30 moves the valve element 28 into an open position against the urging of the bias spring 29 to permit the flow of the aerosol product 11 from the second end 32 of the valve stem 30.

FIGS. 3-6 are various enlarged views of the aerosol spout dispenser 10 of the present invention. The aerosol spout dispenser 10 comprises a base 60 extending between a top portion 61 and a bottom portion 62 with a cylindrical sidewall 63 located therebetween. The sidewall 63 of the base 60 defines an outer surface 64 and an inner surface 65 coaxial with the axis of symmetry 13 of the aerosol spout dispenser 10.

The base 60 includes a base mounting 66 for securing the base 60 to the aerosol container 40. The base mounting 66 is shown as annular base projections 66 extending radially inwardly for securing the base 60 to the aerosol container 40. In this example, the annular base projection 66 engages with the bead 46 of the aerosol container 40. However, it should be understood that various conventional structures may be used for securing the base 60 to the aerosol container 40.

The base 60 includes a base retainer 67 for rotationally securing a dispensing head 70 to the base 60. The base retainer 67 comprises a plurality of annular projections 67 extending radially outwardly from the base 60. The plurality of annular projections 67 are distributed about the axis of symmetry 13 of the aerosol spout dispenser 10.

The dispensing head 70 is shown as unitary member extending between a top portion 71 and a bottom portion 72 with a cylindrical sidewall 73 located therebetween. The sidewall 73 of the dispensing head 70 is a substantially rigid sidewall 73 defining an outer surface 74 and an inner surface 75 coaxial with the axis of symmetry 13 of the aerosol spout dispenser 10. The substantially rigid sidewall 73 of the dispensing head 70 supports a rigid top surface 76.

The dispensing head 70 includes a dispensing head retainer 77 for cooperating with the base retainer 67 for rotationally securing the dispensing head 70 to the base 60. The dispensing head retainer 77 is shown as a plurality of annular projections 77 extending radially inwardly from the inner surface 75 of the sidewall 73 of the dispensing head 70. The radially inwardly extending dispensing head retainers 77 cooperate with the radially outwardly extending base retainers 67 for rotationally securing the dispensing head 70 to the base 60 for inhibiting separation of the dispensing head from the base when a separating force is applied between the dispensing head and the base.

A dispensing spout 80 is formed as a one-piece unit with the dispensing head 70. The dispensing spout 80 extends between a first end 81 and a second end 82. A nozzle passageway 83 is defined within the dispensing head 70 and the dispensing spout 80. An inner end of the nozzle passageway 83 defines a socket 84 for frictionally receiving the first end 31 of the valve stem 30 of the aerosol valve 20. An outer end of the nozzle passageway 83 defines a terminal orifice 86.

The dispensing spout 80 has a portion thereof extending normal to the axis of symmetry 13 of the base 60 beyond the mounting cup 50 of the aerosol container 40. More specifically, the second end 82 of the dispensing spout 80 extends radially outwardly beyond the peripheral rim 52 of the mounting cup 50. The dispensing spout 80 provides an unobstructed view of the delivery of the aerosol product 11 from the terminal orifice 86.

As will be described in greater detail hereinafter, the dispensing head 70 is tiltable relative to the base 60 for actuating the aerosol valve 20 to dispense the aerosol product 11 from the aerosol container 40 through a dispensing spout 80 of the dispensing head 70. The aerosol spout dispenser 10 includes two independent surfaces for actuating the aerosol valve 20. A first actuating surface 91 is formed on an upper surface of the dispensing spout 80 for receiving a finger of a user. A depression of the first actuating surface 91 of the dispensing spout 80 actuates the aerosol valve 20 for discharging aerosol product from the terminal orifice 86 as will be described in greater detail hereinafter. A second actuating surface 92 is formed on a surface of the dispensing head 70 for receiving a finger of a user.

The dispensing head 70 is rotatable relative to the base 60 between an unlocked rotational position as shown in FIGS. 19-24 to a locked rotational position as shown in FIGS. 25-30. The dispensing head 70 is tiltable relative to the base 60 to dispense the aerosol product 11 from the aerosol container 40 when the dispensing head 70 is rotated into the unlocked rotational position as shown in FIGS. 19-24. The dispensing head 70 is inhibited from tilting relative to the base 60 when the dispensing head 70 is moved into the locked rotational position as shown in FIGS. 25-30.

FIGS. 7-12 are various views further illustrating the base 60 shown in FIGS. 3-6. The first end 61 of the base 60 defines an outer ring 100. The outer ring 100 is a substantially cylindrical upper portion of the cylindrical sidewall 63. A plurality of radial ribs 102 extend inwardly from the inner surface 65 of the cylindrical sidewall 63. The plurality of radial ribs 102 supports an inner ring 110. The outer ring 100 and the inner ring 110 are coaxial with the axis of symmetry 13 of the aerosol spout dispenser 10.

Figure 11:
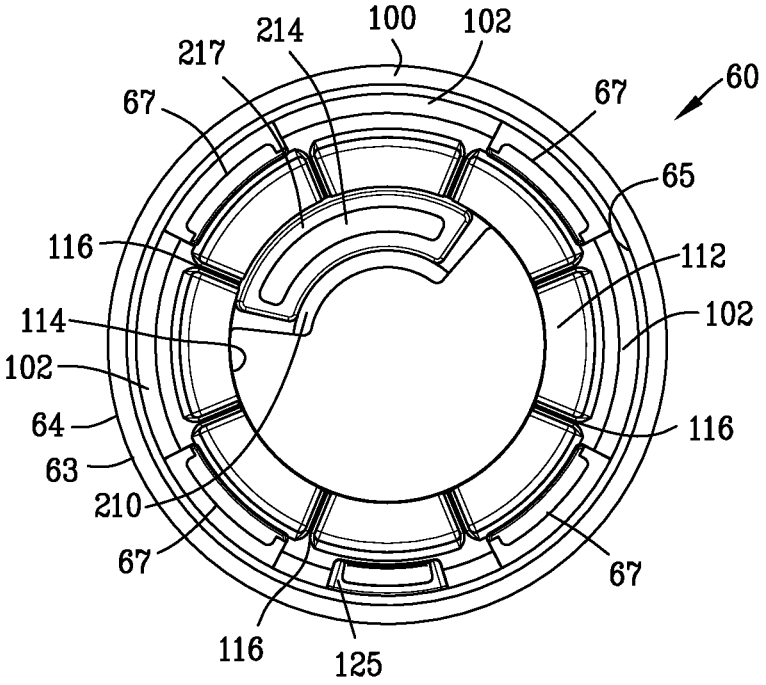
FIG. 11 is a bottom view of FIG. 8.
Figure 12:
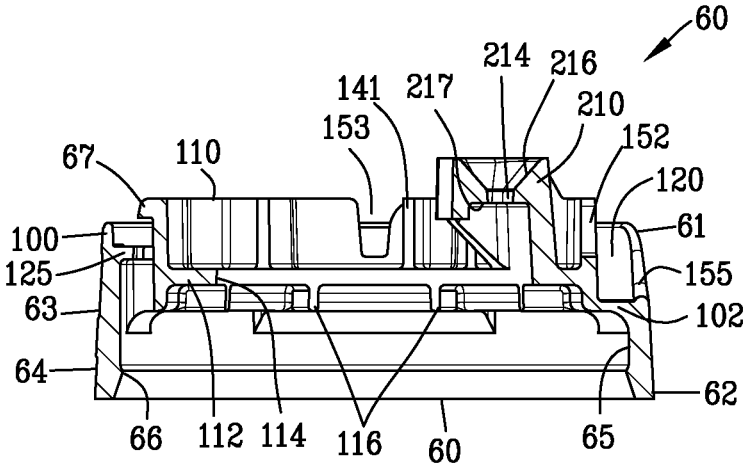
FIG. 12 is a sectional view along line 12-12 in FIG. 8.
Figure 13:
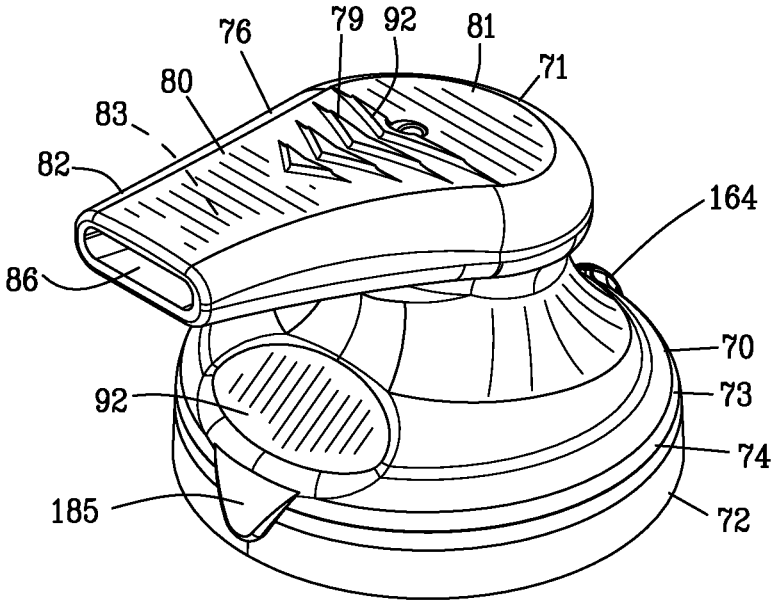
FIG. 13 is a top isometric view of the dispensing head of FIGS. 1-6.
Figure 14:
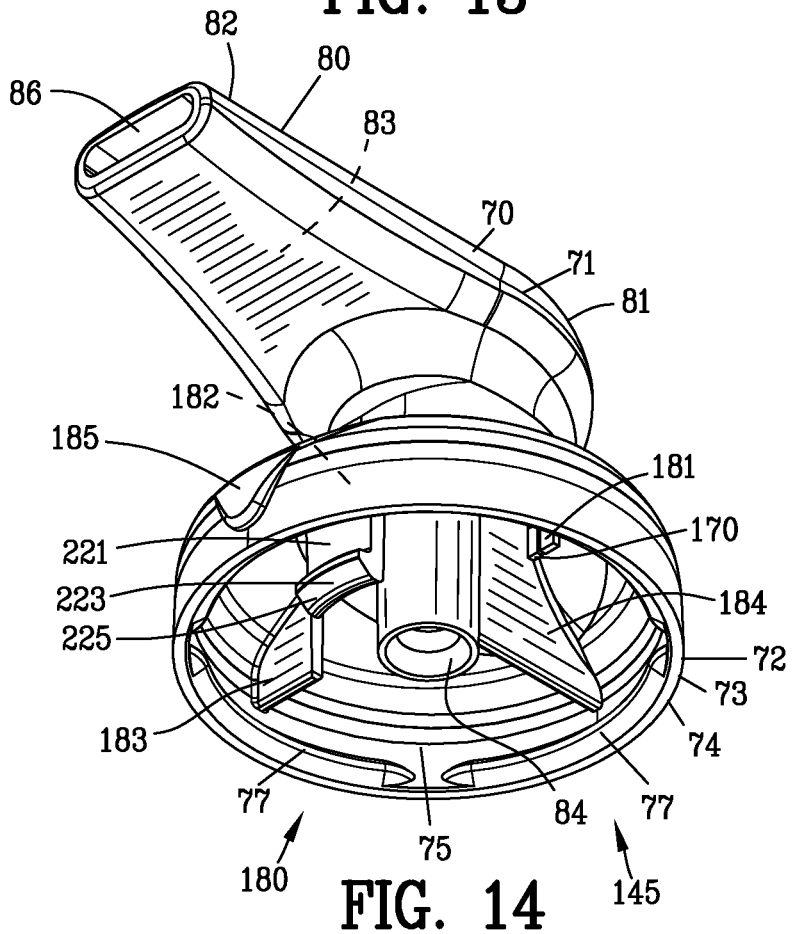
FIG. 14 is a bottom isometric view of the dispensing head of FIGS. 1-6.
Figure 15:
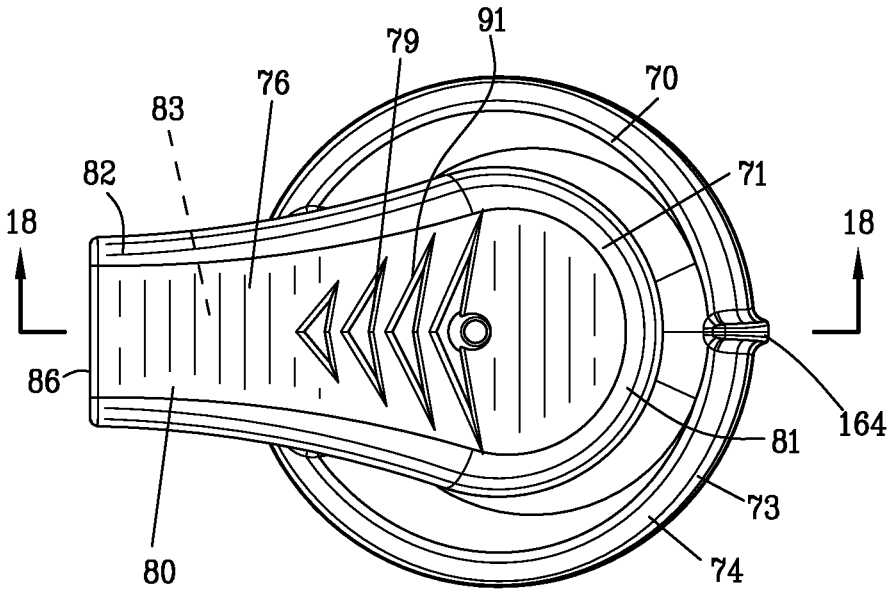
FIG. 15 is a top view of the dispensing head of FIGS. 13-14.
Figure 16:
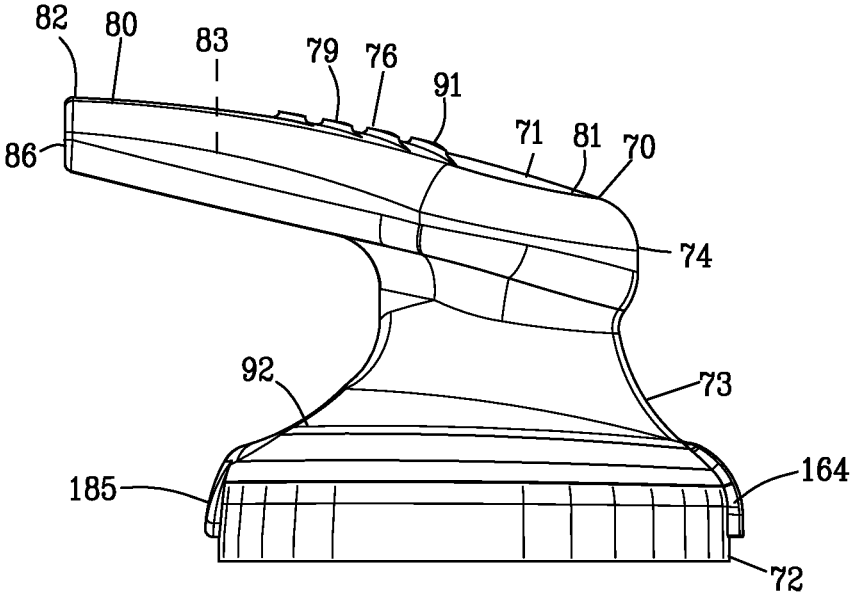
FIG. 16 is a left side view of the dispensing head of FIG. 15.
Figure 17:
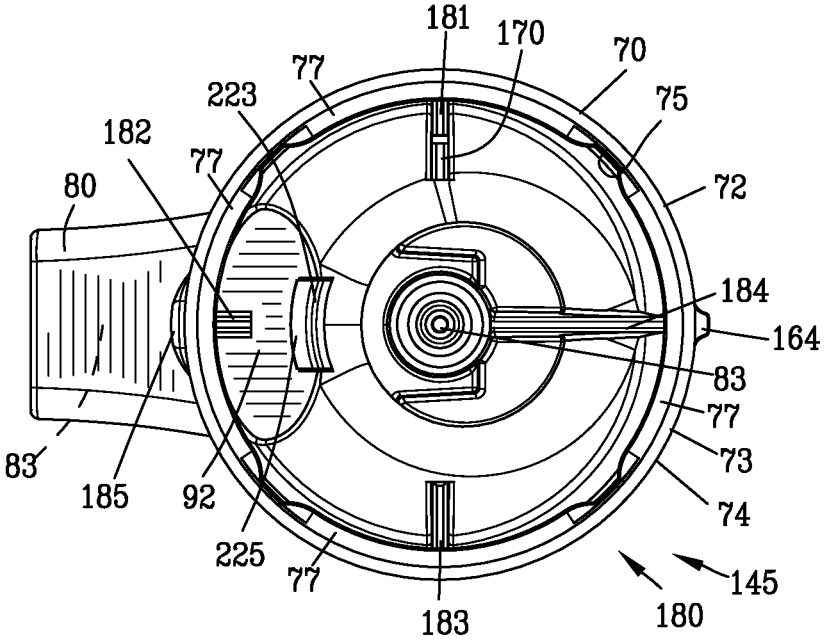
FIG. 17 is a bottom view of FIG. 16.
Figure 18:
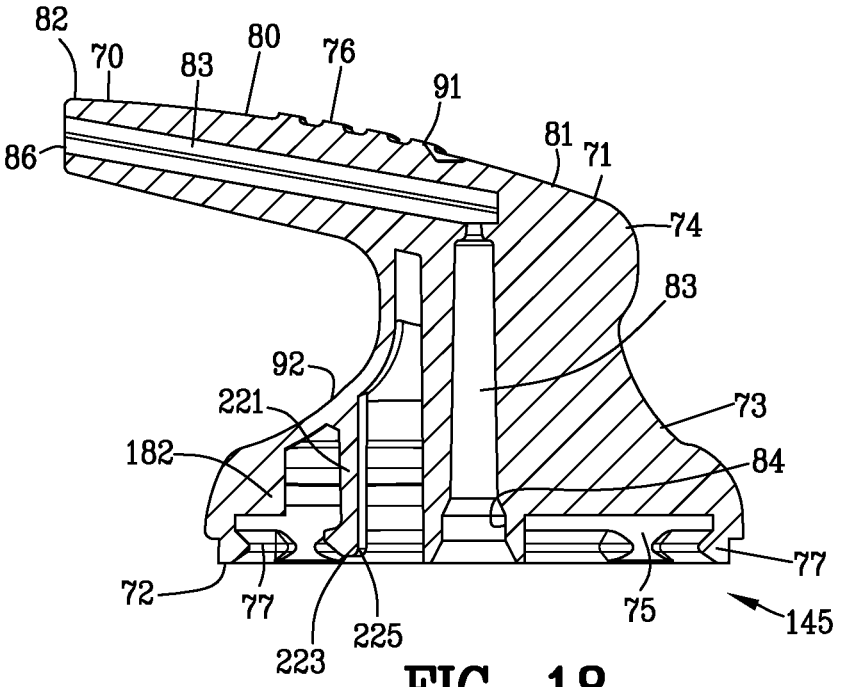
FIG. 18 is a sectional view along line 18-18 in FIG. 15.
Figure 19:
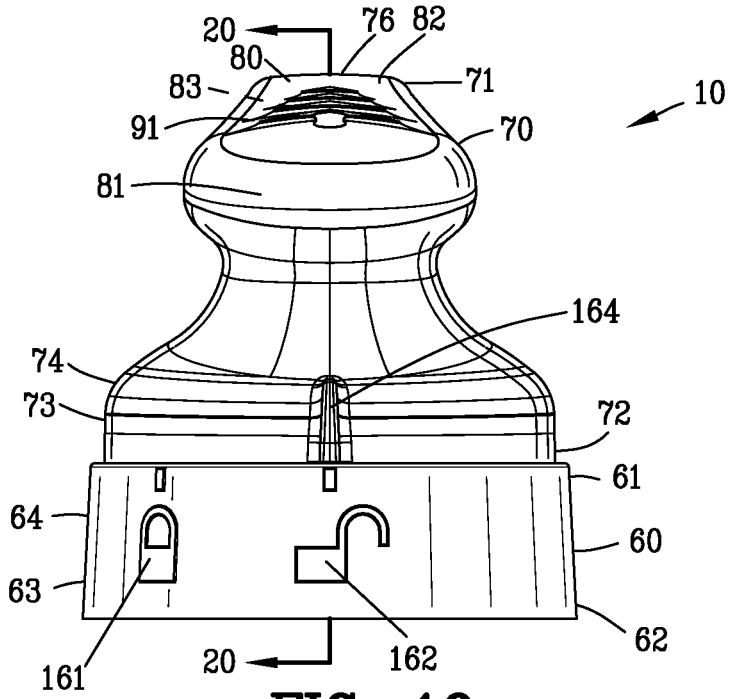
FIG. 19 is a rear view of the aerosol spout dispenser of FIG. 3 in an unlocked rotational position.

An inner base platform 112 extends radially inwardly from the inner ring 110 and defines a central platform aperture 114 coaxial with the outer ring 100 and the inner ring 110. Preferably, the plurality of radial ribs 102 and the inner ring 110 and the inner base platform 112 are integrally formed with the base 60. As best shown in FIGS. 11 and 12, an array of base platform ribs 116 extend from the inner ring 110 to support the underside of the inner base platform 112. The inner base platform 112 defines the central platform aperture 114.

The inner ring 110 supports the base retainer 67 for cooperating with the dispensing head retainer 77 for rotationally securing the dispensing head 70 to the base 60. The base retainer 67 is shown as a plurality of annular projections 67 extending radially outwardly from the inner ring 110 of the base 60. The plurality of annular projections 67 are distributed about the axis of symmetry 13 of the aerosol spout dispenser 10.

Preferably, the inner ring 110 of the base 60 is deformable for enabling the dispensing head retainer 77 to pass over the base retainer 67. After the dispensing head retainer 77 passes over the base retainer 67, the base retainer 67 engages with the dispensing head retainer 77 to retain the dispensing head 70 on the base 60. The dispensing head retainer 77 of the dispensing head 70 interlocks with the base retainer 67 for rotationally securing the dispensing head 70 to the base 60.

The dispensing head retainer 77 of the dispensing head 70 interlocks with the base retainer 67 for inhibiting separation of the dispensing head from the base when a separating force is applied between the dispensing head and the base. The dispensing head retainers 77 and the base retainers 67 inhibits a user from grasping the aerosol container 40 or the base 60 with one user hand and grasps the dispensing head 70 with a second user hand and attempts to remove the dispensing head 70 from the base 60.

A void 120 is defined between the outer ring 100 and the inner ring 110 of the base 60. A bridge 125 extends across the void 120 between the outer ring 100 and the inner ring 110 of the base 60. Preferably, the bridge 125 extends across a portion of the void 120 and is located at a level below the first end 61 of the base 60. The bridge 125 occupies a minor portion of the circumference of the inner ring 110. In this example, the bridge 125 occupies a five to ten degree arc portion of the circumference of the inner ring 110 about the axis of symmetry 13 of the aerosol spout dispenser 10.

The base 60 includes a base stop 130 for cooperating with the dispensing head 70 for establishing an unlocked rotational position and a locked rotational position of the dispensing head 70 relative to the base 60. More specifically, the base stop 130 extends upwardly from the inner base platform 112 and extends inwardly from the inner ring 110 to selectively interfere with the rotation of the dispensing head 70. The base stop 130 includes a locked position stop 131 and an unlocked position stop 132 defined by circumferentially spaced apart lateral surfaces 131 and 132 of the base stop 130. Preferably, the base stop 130 is integrally formed with the inner ring 110 and the inner base platform 112. The locked position stop 131 establishes a locked rotational position of the dispensing head relative to the base 60 as shown in FIGS. 25-30. The unlocked position stop 132 establishes an unlocked rotational position of the dispensing head relative to the base 60 as shown in FIGS. 19-24.

The base 60 includes audible actuator rib 140 for cooperating with the dispensing head 70 for audibly indicating the rotational position of the dispensing head 70 relative to the base 60. In this example, the audible actuator rib 140 comprises plural audible actuator ribs 141 and 142. Each of the plural audible actuator ribs 141 and 142 extends upwardly from the inner base platform 112 and extends inwardly from the inner ring 110.

The aerosol spout dispenser 10 comprises a lock 145 for locking the tilting of the dispensing head 70 relative to the base 60. The lock 145 includes grooves 150 defined on the base 60 cooperating with groove ribs 180 extending from the dispensing head 70. The groove 150 defined in the base 60 receives the groove ribs 180 extending from the dispensing head 70 for enabling the dispensing head 70 to the tilted relative to the base 60 as shown in FIGS. 19-24.

More specifically, the groove 150 includes a plurality of inner grooves 151-153 formed within the inner ring 110 of the base 60. Each of the plurality of inner grooves 151-153 extends through the inner ring 110 to a level in proximity to the inner base platform 114 of the base 60. A base notch 155 is defined in the outer ring 100 of the base 60. The base notch 155 extends through the outer ring 100 to a level commensurate with the level of the plurality of inner grooves 151-153.

Figure 5:
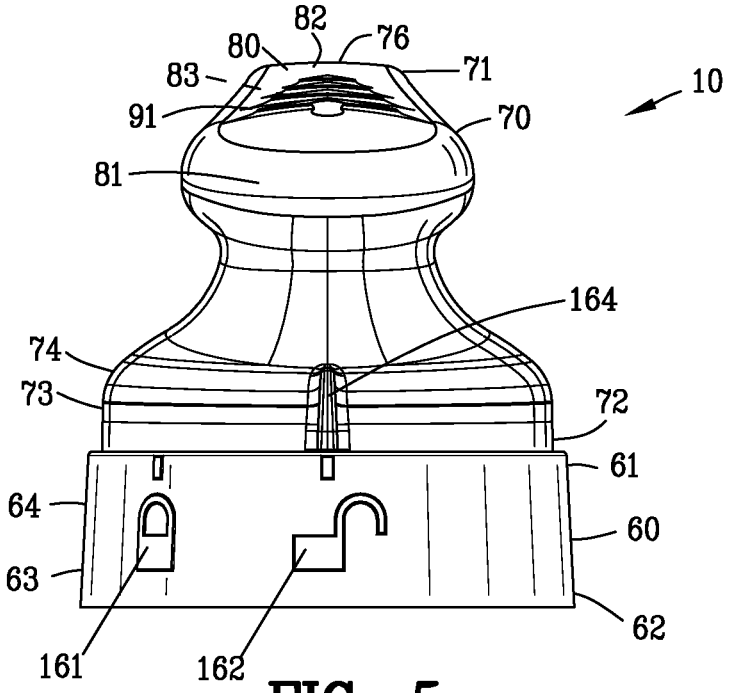
FIG. 5 is a rear view of FIG. 3.
Figure 6:
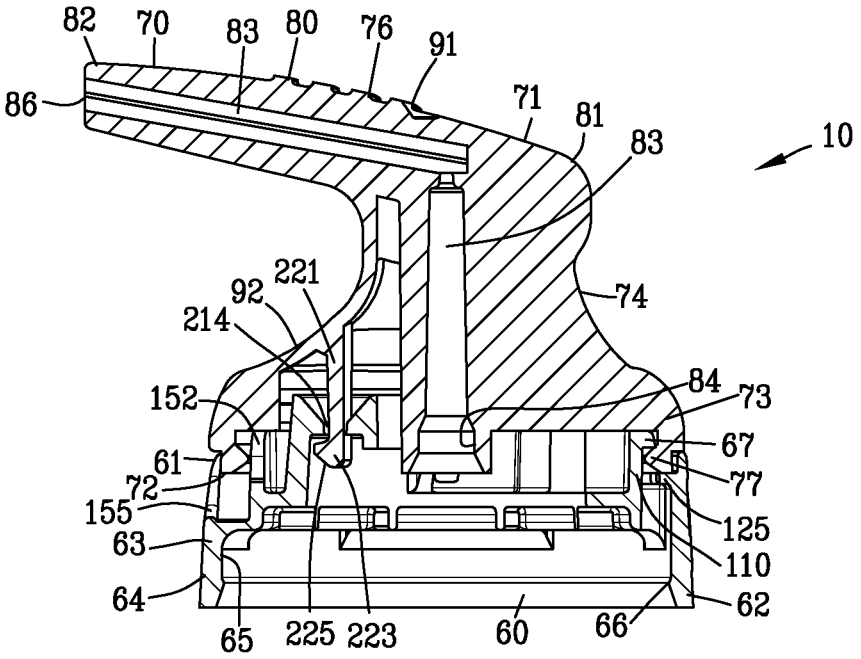
FIG. 6 is a sectional view along line 6-6 in FIG. 3.
Figure 7:
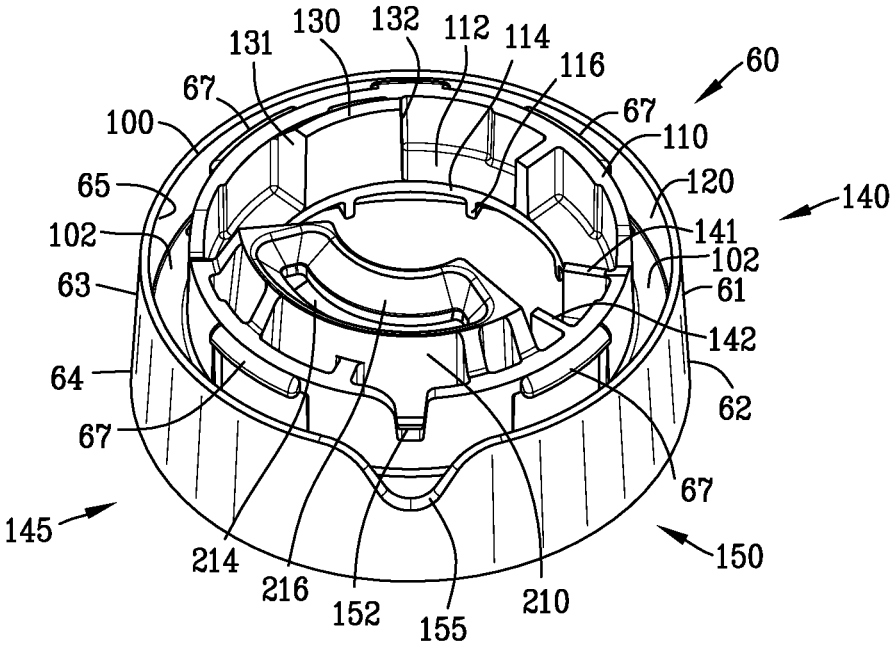
FIG. 7 is a top isometric view of a base of the aerosol spout dispenser of FIGS. 1-6.
Figure 8:
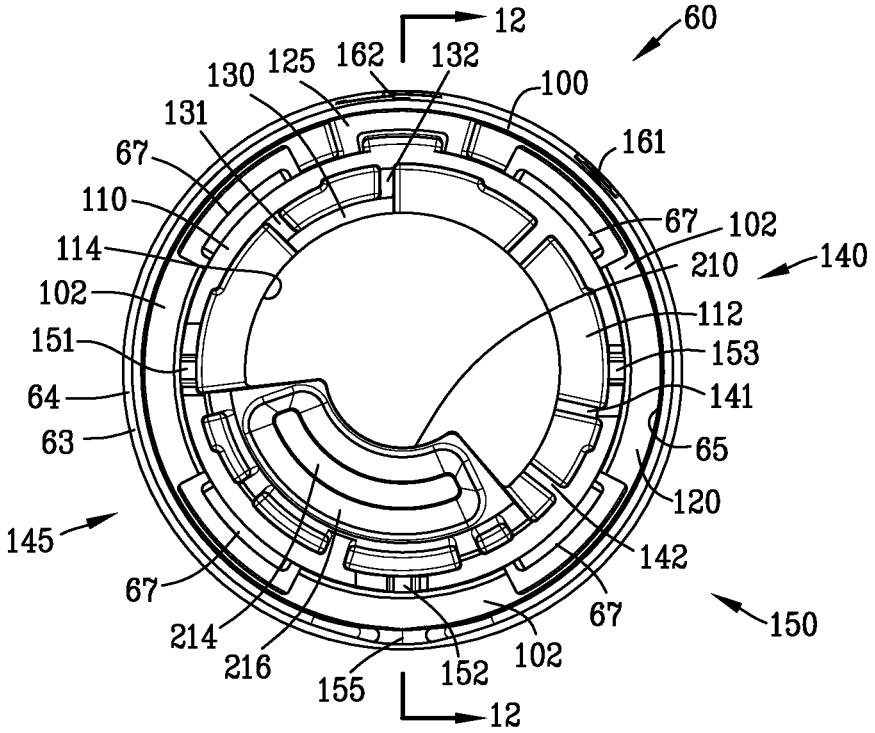
FIG. 8 is a top view of the base shown in of FIGS. 1-6.
Figure 9:
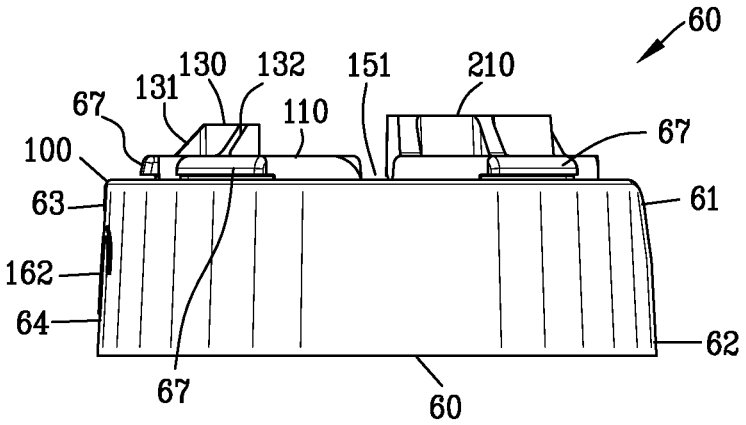
FIG. 9 is a right side view of the base of FIG. 7.
Figure 10:
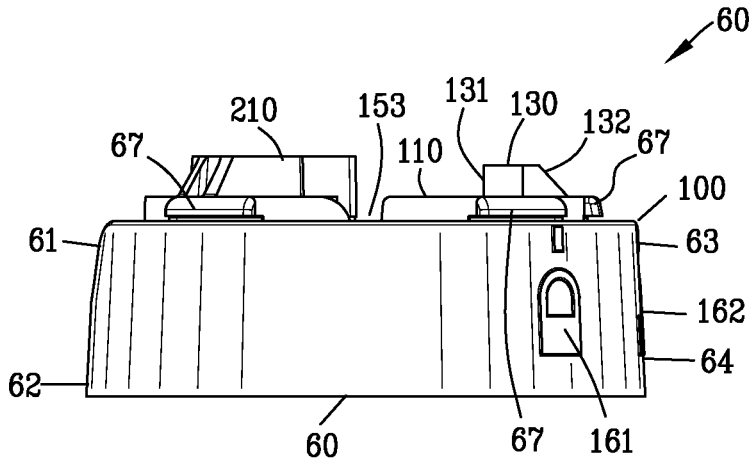
FIG. 10 is a left side view of the base of FIG. 7.

Referring to FIGS. 5, 9 and 10, the aerosol spout dispenser 10 may include a rotation indicator 160 for indicating the rotational position of the dispensing head 70 relative to the base 60. Preferably, the rotation indicator 160 includes a locked rotational position indicator 161 and an unlocked rotational position indicator 162. A rotation marker 164 on the dispensing head 70 functions as an alignment indicator for the locked and unlocked rotational position indicators 161 and 162. In this example, the locked and unlocked rotational position indicators 161 and 162 are located on the outer surface 64 of the base 60, but it should be appreciated by those skilled in the art that numerous variations in the arrangement of the rotation indicator 160 may be incorporated within the present invention.

FIGS. 13-18 are various views further illustrating the dispensing head 70 shown in FIGS. 3-6. The first actuating surface 91 is formed on the top surface 76 of the dispensing head 70. The interior of the dispensing head 70 includes an audible emitting rib 170 shown as an extending projection extending from the rigid top surface 76 of the dispensing head 70. The audible emitting rib 170 interacts with the plural audible actuator ribs 141 and 142 of the base 60. The audible emitting rib 170 sequentially contacts the plural audible actuator ribs 141 and 142 to produce an audible double click upon rotation of the dispensing head 70 relative to the base 60 when the dispensing head is moved between the locked and unlocked rotational position. The dispensing head 70 includes the groove ribs 180 extending from the inner surface 75 and the rigid top surface 76 of the dispensing head 70. Preferably, the groove ribs 180 are formed as a one-piece unit of the actuator button 70. More specifically, the groove ribs 180 includes inner grooves 181-183 equally spaced about the axis of symmetry 13 of the aerosol spout dispenser 10. A dispensing head boss 185 is formed on the outer surface 76 of the dispensing head 70.

The plurality of groove ribs 181-184 of the dispensing head 70 are misaligned with the plurality of grooves 151-153 defined by the inner ring 110 of the base 60 when the dispensing head 70 is located in the locked rotational position as shown in FIGS. 25-30. Similarly, the head boss 185 of the dispensing head 70 is misaligned with the base notch 155 defined by the outer ring 100 of the base 60 when the dispensing head 70 is located in the locked rotational position as shown in FIGS. 25-30.

The plurality of groove ribs 181-183 of the dispensing head 70 are aligned with the plurality of grooves 151-153 defined by the inner ring 110 of the base 60 when the dispensing head 70 is established in the unlocked rotational position as shown in FIGS. 19-24. In the unlocked rotational position, the head boss 185 is aligned with the base notch 155 defined by the outer ring 100 of the base 60.

As will be described hereinafter, the groove ribs 183 and 184 interact with the locked position stop 131 and the unlocked position stop 132 of the base stop 130 for establishing the locked rotational position and the unlocked rotational position of the dispensing head 70 relative to the base 60.

FIGS. 19-22 are various views of the aerosol spout dispenser 10 of FIGS. 1-6 with the dispensing head 70 being located in the unlocked rotational position. The dispensing head 70 is rotated clockwise relative to the base 60 until the groove rib 183 of the dispensing head 70 engages the lock position stop 131 of the base 60. During the clockwise rotation of the dispensing head 70 from the unlocked rotational position to the locked rotational position, the audible emitting rib 170 of the dispensing head 70 passes over the plural audible ribs 141 and 142, respectively, to provide two independent audible clicks. The audible emitting rib 170 of the dispensing head 70 cooperates with the audible rib 142 to maintain the dispensing head 70 in the locked rotational position.

When the dispensing head 70 is located in the unlocked rotational position, the plurality of groove ribs 181-184 are aligned with the plurality of grooves 151-154 of the base to enable the dispensing head 70 to tilt relative to the base 60. The groove rib 184 is aligned with the bridge 125. The alignment of the groove ribs 181-184 with the grooves 151-154 permits the dispensing head 70 to be tilted relative to the base 60 to actuate the aerosol valve 20.

Figure 20:
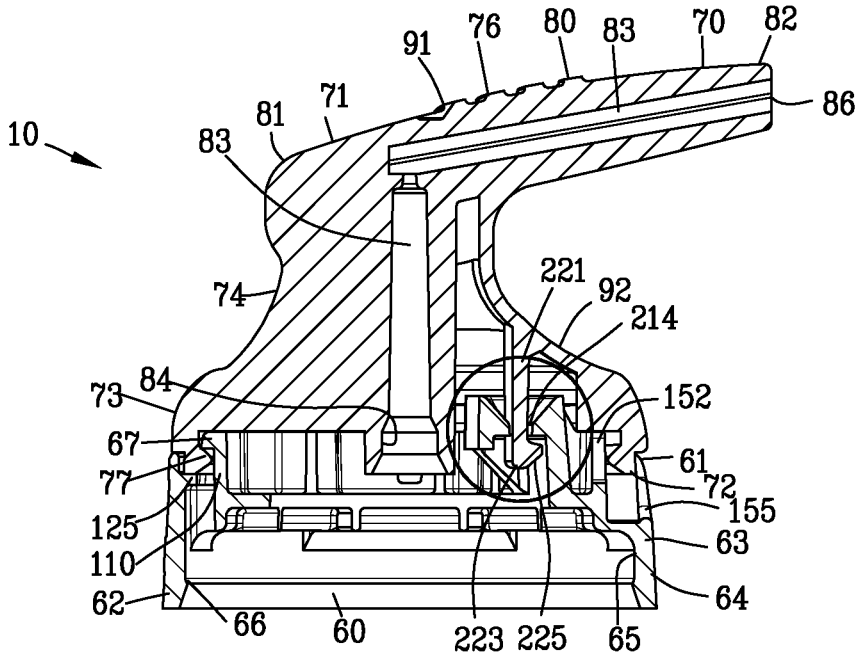
FIG. 20 is a sectional view along line 20-20 in FIG. 19.
Figure 21:
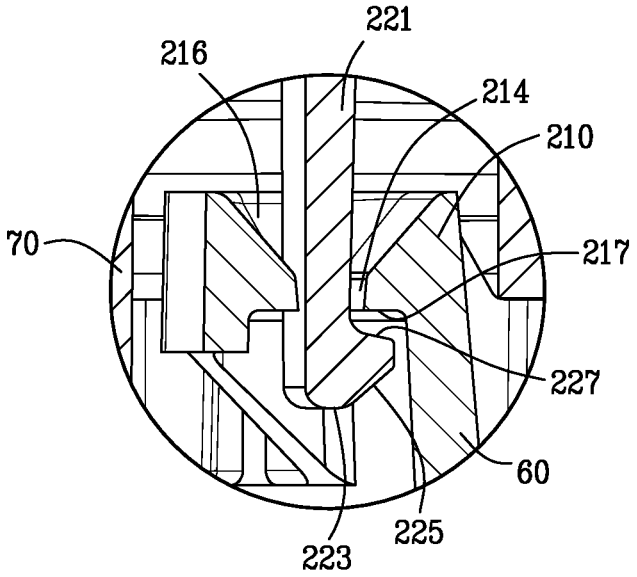
FIG. 21 is a magnified view of a portion of FIG. 20.

FIG. 21 is a magnified view of a portion of FIG. 20 illustrating an auxiliary latching mechanism 210. The auxiliary latching mechanism 210 inhibits separation of the dispensing head 70 from the base 60. The dispensing spout 80 of the dispensing head 70 provides a mechanical advantage for intentionally or inadvertently separating the dispensing head 70 from the base 60. The dispensing head 70 can be separated from the base 60 by (1) an excess depressing force applied to the dispensing spout 80, (2) an excess lifting force applied to the dispensing spout 80 and (3) an improper use and/or abuse of the aerosol spout dispenser 10. The auxiliary latching mechanism 210 inhibits such intentional or inadvertent separation of the dispensing head 70 from the base 60.

The auxiliary latching mechanism 210 comprises arcuate base locking plate 212 extending from the inner base platform 112 into the central platform aperture 114 of the base 60. The arcuate base locking plate 212 is unitary with the base 60. An arcuate lock slot 214 is defined in the arcuate base locking plate 212. The arcuate base locking plate 212 includes a tapered surface 216 and a locking plate locking underside 217.

A locking rib 221 extends downwardly from the dispensing head 70. The distal end of the locking rib 211 is provided with a locking rib barb 223 having a ramp surface 225 and a locking surface 227. The locking rib 221 and locking rib barb 223 are unitary with the dispensing head 70. At lease one of the arcuate base locking plate 212 and/or the locking rib 221 are formed from a resilient polymeric material.

The locking rib 221 is receivable within the arcuate lock slot 214 defined within the arcuate base locking plate 212. The resilient arcuate lock slot 214 and/or the resilient locking rib 221 are deformed as the locking surface 227 passes through the arcuate lock slot 214. When the resilient arcuate lock slot 214 and/or resilient locking rib 221 return to a non-deformed condition, the locking surface 227 of the locking barb 223 engage an underside 217 of the arcuate base locking plate 212 to prevent separation of the dispensing head 70 from the base 60. The auxiliary latching mechanism 210 prevents separation of the dispensing head 70 from the base 60E while permitting rotation movement of the dispensing head 70 relative to the base 60 and while permitting a tilting and/or downward movement of the dispensing head 70 for actuating the aerosol valve 20.

Figure 22:
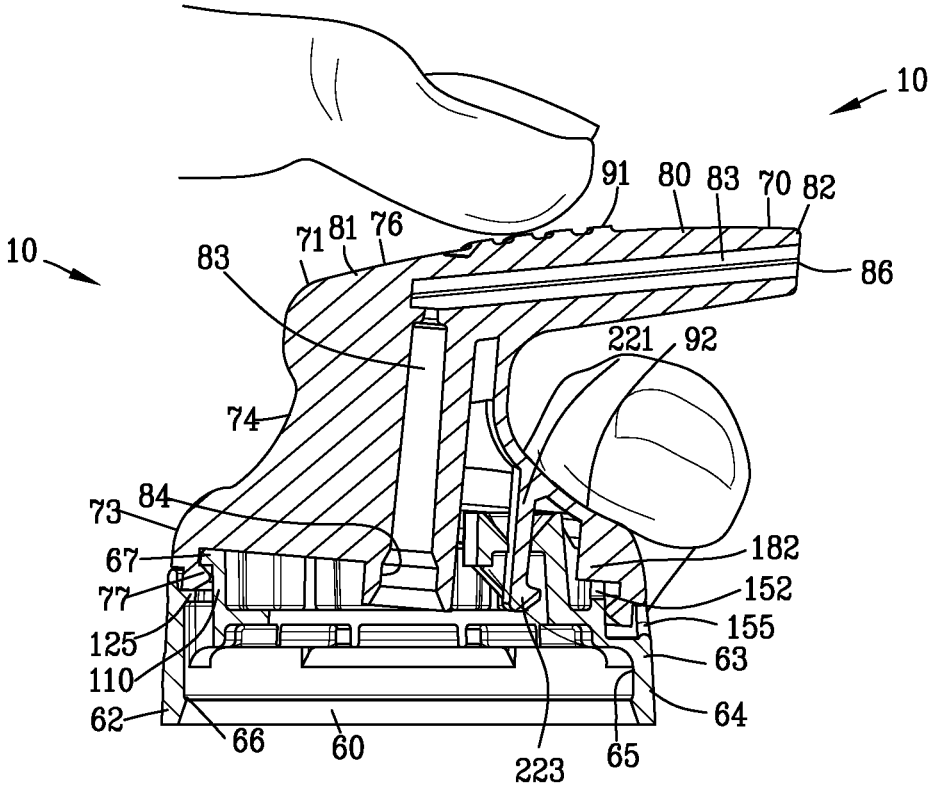
FIG. 22 is sectional view similar to FIG. 20 illustrating alternate actuation of the dispensing head by a depression of a first actuating surface on the aerosol spout and alternatively by a depression of a second actuating surface on the dispensing head.

FIG. 22 illustrates the aerosol spout dispenser 10 being actuated by the depression of the first actuating surface 91 and the alternate second actuating surface 92. The improved aerosol spout dispenser 10 of the present invention provides the advantage of a dual actuation aerosol dispenser. The dual actuation enables a user to have the option of two different forms of actuation. For example, an operator may use the first actuating surface 91 of the dispensing spout 80 for applying a specific product in a one manner using the mechanical advantage to reduce finger fatigue in applying the specific product. However, the same operator may use the second actuating surface 92 of the dispensing head 70 for applying the specific product in a different manner. The different uses of the dual actuation aerosol dispenser of the present invention are too numerous to mention and the immediate advantages of such the dual actuation aerosol dispenser should be readily apparent to those skilled in the art.

Figure 23:
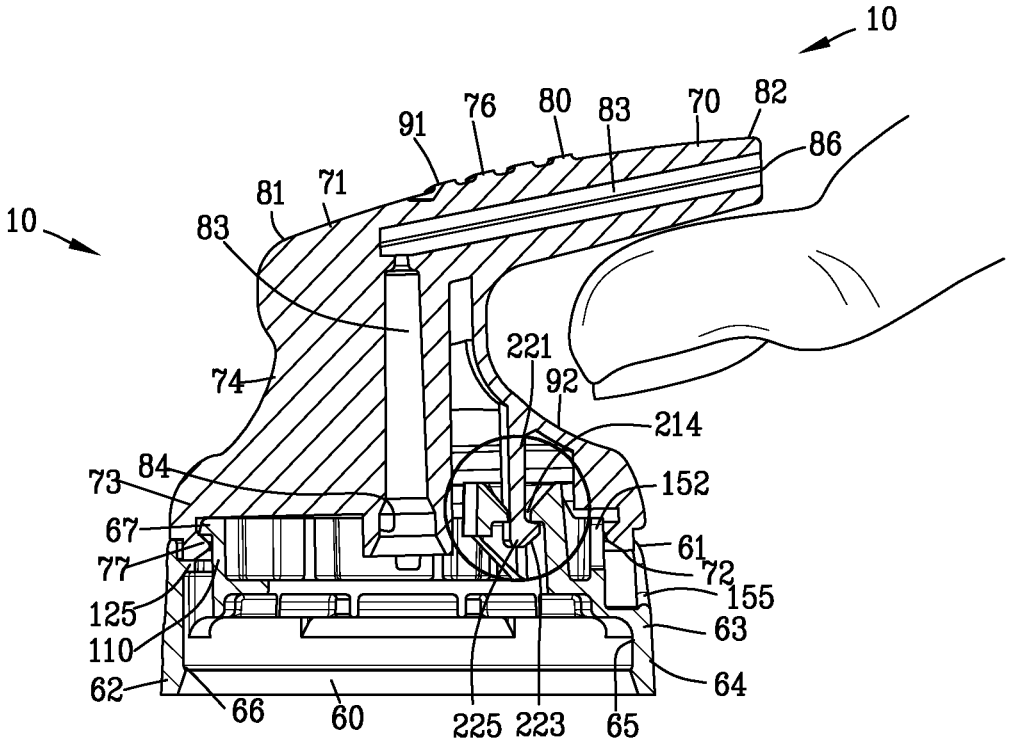
FIG. 23 is a view similar to FIG. 20 with the aerosol spout being subjected to an upward force.
Figure 24:
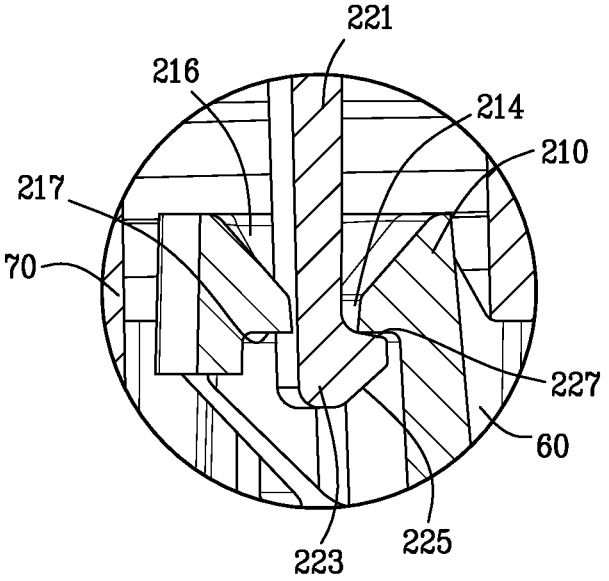
FIG. 24 is a magnified view of a portion of FIG. 23.
Figure 25:
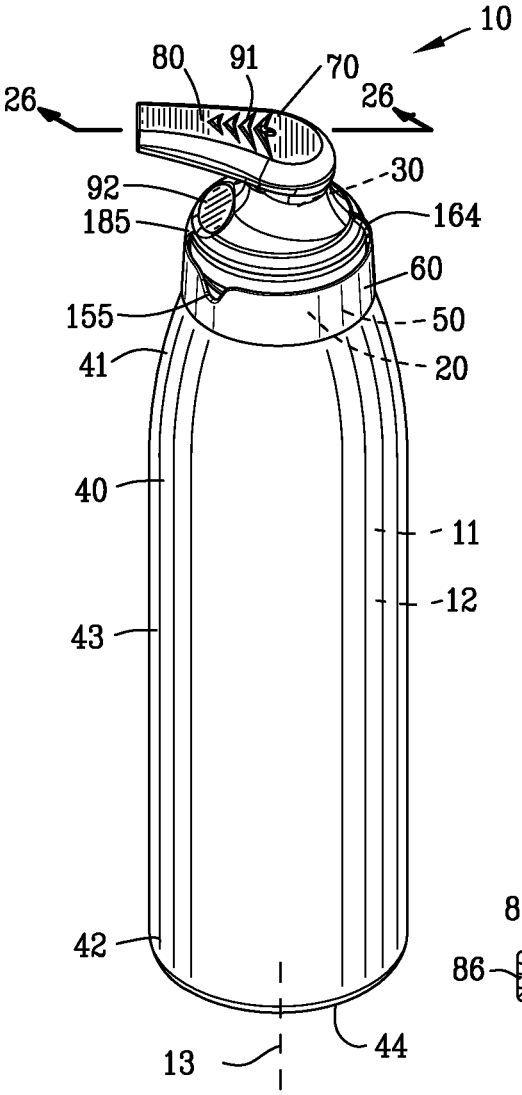
FIG. 25 is a top isometric view of the aerosol spout dispenser of the present invention located on an aerosol container shown in a locked position.
Figure 26:
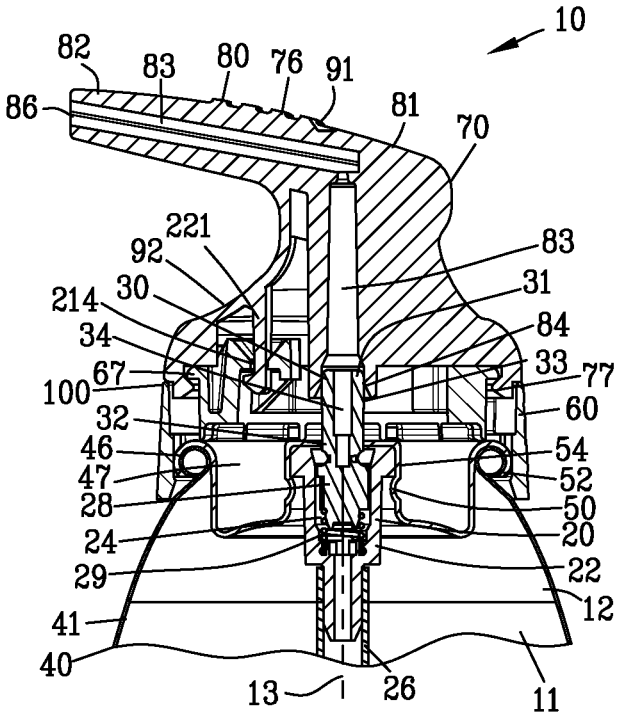
FIG. 26 is an enlarged sectional view along line 26-26 in FIG. 25.
Figure 27:
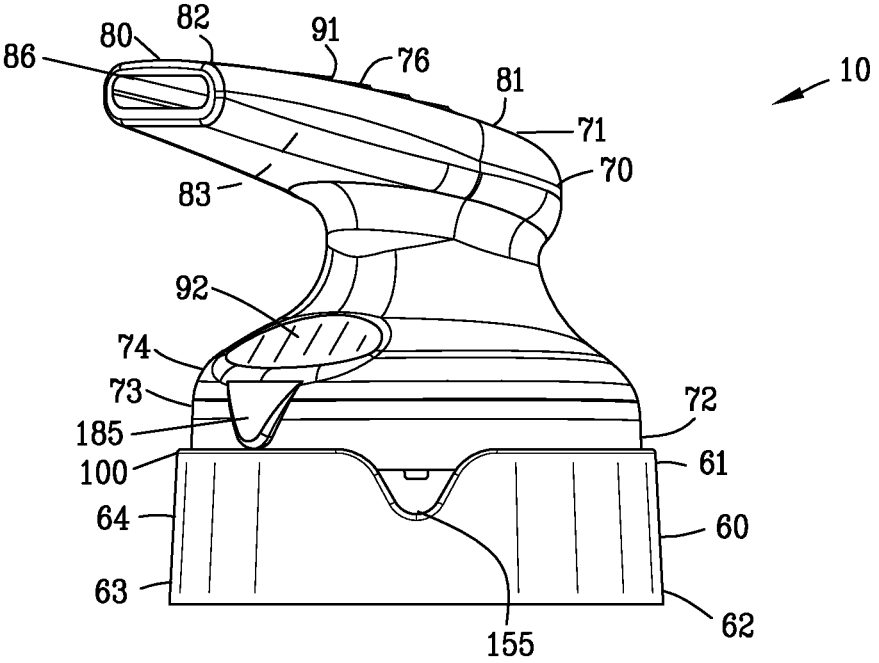
FIG. 27 is an enlarged front view of the aerosol spout dispenser of FIG. 25 shown in the locked position.
Figure 28:
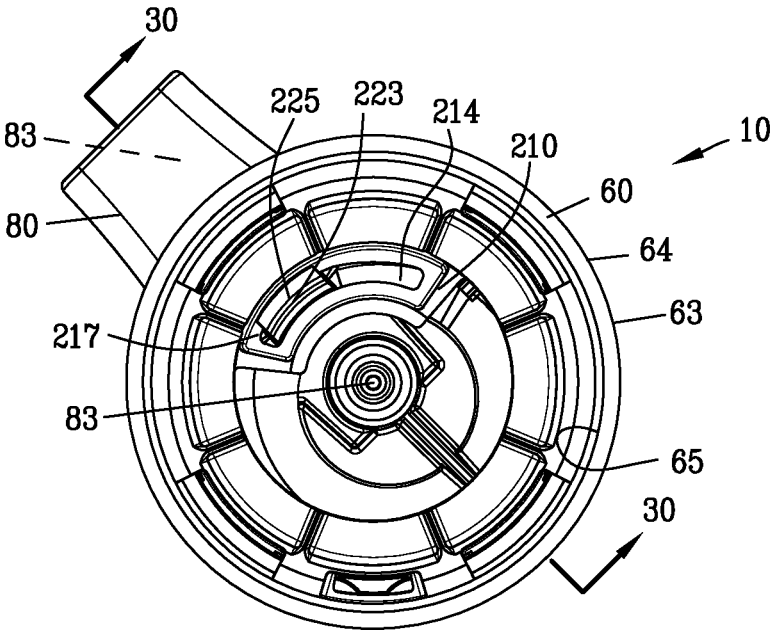
FIG. 28 is a bottom view of in FIG. 27.
Figure 29:
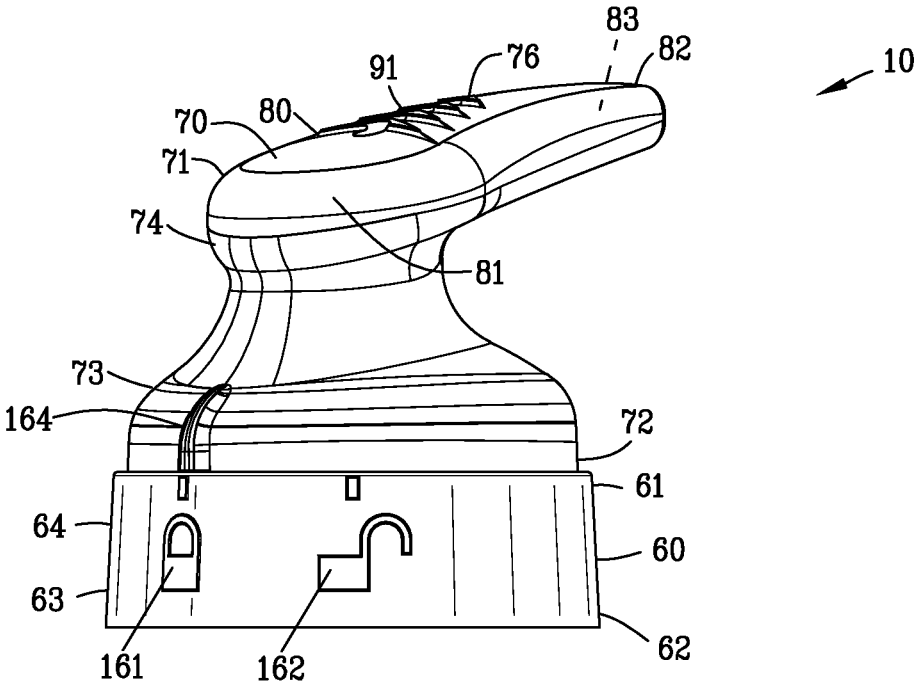
FIG. 29 is a rear view of the aerosol spout dispenser of FIG. 27.
Figure 30:
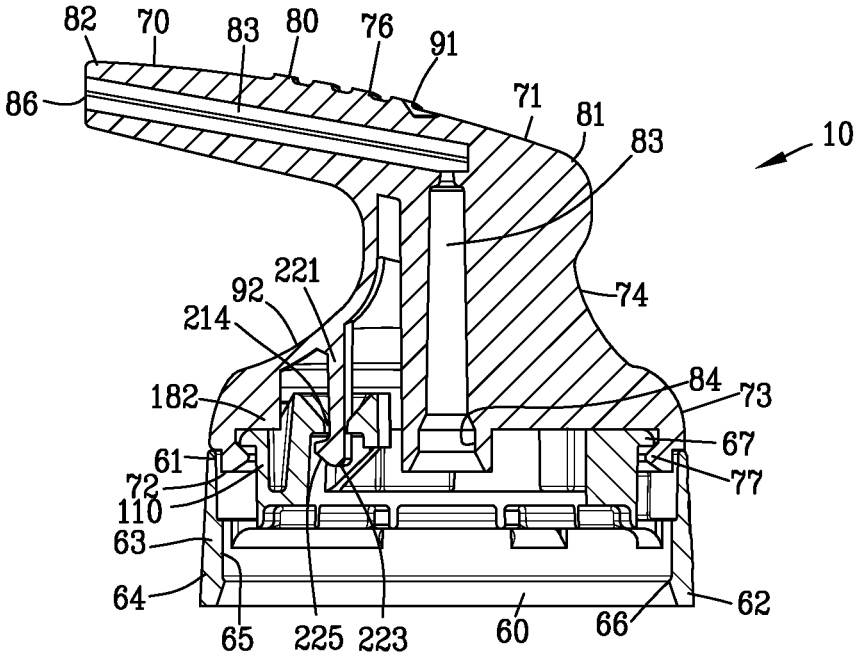
FIG. 30 is a sectional view along line 30-30 in FIG. 28.

FIGS. 23-24 illustrate the aerosol spout dispenser 10 being subjected to a separating force is applied between the dispensing spout 80 and the base 60 and/or the aerosol container 40. The locking surface 227 of the locking barb 223 engage an underside 217 of the arcuate base locking plate 212 to prevent separation of the dispensing head 70 from the base 60. The lever arm of the dispensing spout 80 provides a mechanical advantage for a user to separate the dispensing head 70 from the base 60. The auxiliary latching mechanism 10 inhibits separation of the dispensing head 70 from the base 60 when a separating force is applied between the dispensing spout 80 and the base 60 and/or the aerosol container 40.

FIGS. 25-30 are various views of the aerosol spout dispenser 10 of FIGS. with the dispensing head 70 being located in the locked rotational position and with the dispensing head 70 being in an actuated position. The dispensing head 70 has been rotated counterclockwise relative to the base 60 until the groove rib 183 of the dispensing head 70 engages the unlock position stop 132 of the base 60. During the counterclockwise rotation of the dispensing head 70 from the locked rotational position to the unlocked rotational position, the audible emitting rib 170 of the dispensing head 70 passes over the plural audible ribs 142 and 141, respectively, to provide two independent audible clicks. The audible emitting rib 170 of the dispensing head 70 cooperates with the audible rib 141 to maintain the dispensing head 70 in the unlocked rotational position.

When the dispensing head 70 is located in the locked rotational position, the plurality of groove ribs 181-184 are misaligned with the plurality of grooves 151-154 of the base 60 to inhibit the dispensing head 70 from tilting relative to the base 60.

In the locked rotational position, the dispensing head boss 185 is misaligned with the base notch 155. The dispensing head boss 185 engages with the top portion 61 of the outer ring 100 of the base 60 to prevent the dispensing head 70 from tilting about the bridge 125 to actuate the aerosol valve 20. The engagement of the dispensing head boss 185 with the top portion 61 of the outer ring 100 of the base 60 reinforces the mechanical strength of the substantially flat dispensing spout 80. This reinforcement of the mechanical strength of the substantially flat and horizontal dispensing spout 80 facilitates the shipping of multiple levels of the aerosol spout dispensers 10.

The present invention provides an improved aerosol spout dispenser having a dispensing spout. The aerosol spout dispenser may be actuated either by a depression of the dispensing spout or alternately be actuated by a depression of the dispenser head. The aerosol spout dispenser has a reduced number of parts and preferably a base and a dispensing head. A retainer inhibits separation of said dispensing head from said base when a separating force is applied between said dispensing head and said base. An auxiliary latching mechanism inhibits separation of said dispensing head from said base when a separating force is applied between said dispensing spout and said base. The aerosol spout dispenser includes a lock for inhibiting actuation of the aerosol spout dispenser.

The improved aerosol spout dispenser of the present invention provides several ergonomic advantages over the prior art. The improved aerosol spout dispenser may be actuated on a counter or table top or may be actuated in a hand of a user. The improved aerosol spout dispenser is capable of dispensing product into a hand of a user or directly upon the application surface. The aerosol spout dispenser provides enhanced gripping of the aerosol spout dispenser as well as an unobstructed view of the product delivery.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A two-piece aerosol spout dispenser for dispensing an aerosol product from an aerosol container having a mounting cup for supporting an aerosol valve, comprising:

a first piece comprising:

a base having a mounting unitary with said base for securing said base to the mounting cup of the aerosol container;

a base retainer unitary with said base;

a second piece comprising:

a dispensing head having a dispensing spout extending from the dispensing head defining a terminal orifice communicating with the aerosol valve;

said dispensing spout extending beyond the mounting cup of the aerosol container;

said dispensing head being tiltable relative to said base upon depression of said dispensing spout for opening the aerosol valve to dispense the aerosol product from said terminal orifice;

a dispensing head retainer unitary with said dispensing head cooperating with said base retainer for inhibiting separation of said dispensing head from said base when a separating force is applied between said dispensing head and said base; and a first actuator surface defined by a top surface of said dispensing stout;

a second actuator surface defined by a surface of said dispensing heat actuator below said dispensing spout; and each of said first and second actuation surfaces being capable of actuating the aerosol valve to dispense the aerosol product from said terminal orifice.

2. A two-piece aerosol spout dispenser as set forth in claim 1, wherein said base has an outer ring and an in ring defining an annular void between said outer ring and said inner ring of said base; and a portion of said dispensing head extending into said annular void between said outer ring and said inner ring of said base.

3. A two-piece aerosol spout dispenser as set forth in claim 1, wherein said base has an outer ring and an inner ring, defining an annular void between said outer ring and said inner ring of said base;

said dispensing head being tiltable within said annular void of said base upon actuation of said dispensing spout for opening the aerosol valve to dispense the aerosol product from said terminal orifice.

4. A two-piece aerosol spout dispenser as set forth in claim 1, including a lock to inhibit said dispensing spout from actuating the aerosol valve; and said lock interacting between said base and said dispensing head for inhibiting said dispensing spout from actuating the aerosol valve.

5. A two-piece aerosol spout dispenser as set forth in claim 1, wherein said dispensing head is rotatably mounted to said base for rotation between a locked rotational position and an unlocked rotational position;

said dispensing spout actuating the aerosol valve upon depression of said dispensing spout when said dispensing head is rotated into said unlocked rotational position; and said dispensing spout being inhibited from actuating the aerosol valve when said dispensing head is rotated into said locked rotational position.

6. A two-piece aerosol spout dispenser as set forth in claim 1, including a lock unitary with one of said first and second pieces for inhibiting said dispensing spout from actuating the aerosol valve.

7. A two-piece aerosol spout dispenser for dispensing an aerosol product from an aerosol container having a mounting cup for supporting an aerosol valve, comprising:

a first piece comprising:

a base having a mounting unitary with said base for securing said base to the mounting cup of the aerosol container;

a base retainer unitary with said base;

a second piece comprising:

a dispensing bead having a dispensing spout extending from the dispensing head defining a terminal orifice communicating with the aerosol valve;

said dispensing spout extending beyond the mounting cup of the aerosol container;

said dispensing head being tiltable relative to said base upon depression of said dispensing spout for opening the aerosol valve to dispense the aerosol product from said terminal orifice;

a dispensing head retainer unitary with said dispensing head cooperating with said base retainer for inhibiting separation of said dispensing head from said base when a separating force is applied between said dispensing head and said base;

an auxiliary latching mechanism for inhibiting separation of said dispensing head from said base when a separation force is applied between said dispensing spout and said base;

a first actuator surface defined by a top surface of said dispensing spout;

a second actuator surface defined by a surface of said dispensing bead actuator below said dispensing spout; and each of said first and second actuation surfaces being capable of actuating the aerosol valve to dispense the aerosol product from said terminal orifice.

8. A lockable aerosol dispenser for dispensing an aerosol product from an aerosol container through an aerosol valve, comprising:

a base defined about an axis of symmetry of said base;

a base retainer extending from said base;

a mounting for securing said base to the aerosol container;

a dispensing head having a dispensing spout extending from the dispensing head defining a terminal orifice communicating with the aerosol valve;

said dispensing spout having a portion thereof extending normal to said axis of symmetry of said base beyond the mounting cup of the aerosol container;

a dispensing head retainer extending from said dispensing head cooperating with said base retainer for rotationally securing said dispensing bead to said base when a separating force is applied between said dispensing head and said base;

an auxiliary latching mechanism for inhibiting separation of said dispensing head from said base when a separating force is applied between said dispensing spout and said base;

said dispensing head being rotatable about said axis of symmetry of said base between a locked rotational position and an unlocked rotational position;

a first actuator surface defined by a top surface of said dispensing spout for actuating the aerosol valve upon depression of said first actuator surface to dispense the aerosol product from said terminal orifice when said dispensing head is rotated into said unlocked rotational position;

a second actuator surface defined by a surface of said dispensing head actuator below said dispensing spout for actuating the aerosol valve upon depression of said second actuator surface to dispense the aerosol product from said terminal orifice when said dispensing head is rotated into said unlocked rotational position, and said dispensing spout being inhibited from actuating the aerosol valve when said dispensing head is rotated into said locked rotational position.

9. A lockable aerosol dispenser as set forth in claim 8, wherein said dispensing head is tiltable to open the aerosol valve for dispensing the aerosol product from said terminal orifice when said dispensing bead is rotated into said unlocked rotational position; and said dispensing head being inhibited from tilting when said dispensing head is rotated into said locked rotational position.

10. A lockable aerosol dispenser as set forth in claim 8, wherein said base has an outer ring and an inner ring defining an annular void between said outer ring and said inner ring of said base;

said dispensing head being tiltable within said annular void of said base for opening the aerosol valve for dispensing aerosol product from said terminal orifice when said dispensing head is rotated into said unlocked rotational position;

said dispensing head being inhibited from tilting within said annular void of said base when said dispensing head is rotated into said locked rotational position.

11. A lockable dual actuation aerosol dispenser for dispensing an aerosol product from an aerosol container through an aerosol valve, comprising:

a base defined about an axis of symmetry of said base;

a base retainer extending from said base;

a mounting, for securing said base to the aerosol container;

a dispensing head having, a dispensing spout extending from said dispensing head defining a terminal orifice communicating with the aerosol valve;

said dispensing spout having a portion thereof extending normal to said axis of symmetry of said base beyond the mounting cup of the aerosol container defining a terminal orifice;

a dispensing bead retainer extending from said dispensing head cooperating with said base retainer for rotationally securing said dispensing head to said base; a lock having a locked position and an unlocked position;

a first actuator surface defined by a top surface of said dispensing spout;

a second actuator surface defined by a surface of said dispensing head actuator below said dispensing spout;

each of said first and second actuation surfaces being capable of actuating the aerosol valve for dispensing the aerosol product from said terminal orifice when said lock is in said unlocked position; and each of said first and second actuation surfaces being inhibited from actuating the aerosol valve when said lock is in said locked position.

12. A dual actuation two-piece aerosol spout dispenser for dispensing an aerosol product from an aerosol container having a mounting cup for supporting an aerosol valve, comprising:

a first piece comprising:

a base having a mounting unitary with said base for securing said base to the mounting cup of the aerosol container;

a base retainer unitary with said base;

a second piece comprising:

a dispensing head having a dispensing spout extending from the dispensing head defining a terminal orifice communicating with the aerosol valve;

said dispensing spout extending beyond the mounting cup of the aerosol container;

a dispensing head retainer unitary with said dispensing bead cooperating with said base retainer for rotationally securing said dispensing head to said base and for inhibiting separation of said dispensing head from said base when a separating force is applied between said dispensing head and said base;

said dispensing head being rotatable between a locked rotational position and an unlocked rotational position;

a first actuator surface defined by a top surface of said dispensing spout;

a second actuator surface defined by a surface of said dispensing head actuator below said dispensing spout; and each of said first and second actuation surfaces being capable of actuating the aerosol valve to dispense the aerosol product from said terminal orifice when said dispensing, head is rotated into said unlocked rotational position.

* * * * *